US005626556A

United States Patent [19]

Tobler et al.

[11] Patent Number: 5,626,556

[45] Date of Patent: May 6, 1997

[54] HOOK AND LOOP ATTACHMENT FOR A COMPRESSION SLEEVE AND METHOD OF ATTACHING A HOOK AND LOOP FASTENER TO A COMPRESSION SLEEVE

[75] Inventors: Arnold Tobler, Liberty; Lafoy Ellenburg, Seneca; David T. Melton, West Union; John E. Pendergrass, Seneca, all of S.C.

[73] Assignee: The Kendall Company, Mansfield, Mass.

[21] Appl. No.: 567,397

[22] Filed: Dec. 5, 1995

Related U.S. Application Data

[63] Continuation of Ser. No. 280,800, Jul. 26, 1994, abandoned.

[51] Int. Cl.[6] ..... A61H 9/00

[52] U.S. Cl. ..... 601/151; 601/152; 128/DIG. 20

[58] Field of Search ..... 601/15, 148–152; 602/13; 128/DIG. 15, DIG. 20; 24/444, 447, 448; 156/66, 272.2, 274.4, 274.8

[56] References Cited

U.S. PATENT DOCUMENTS

| | | | |
|---|---|---|---|
| 2,467,133 | 4/1949 | Irons . | |
| 2,660,660 | 11/1953 | Hauteville . | |
| 2,865,790 | 12/1958 | Baer . | |
| 3,046,179 | 7/1962 | Stallard . | |
| 3,126,307 | 3/1964 | Drittenbass . | |
| 3,391,434 | 7/1968 | Girard | 24/444 |
| 3,393,119 | 7/1968 | Dugan . | |
| 3,535,184 | 10/1970 | Schwartz . | |
| 3,576,690 | 4/1971 | Staats et al. . | |
| 3,616,028 | 10/1971 | Miller et al. . | |
| 3,647,607 | 3/1972 | Hillers . | |
| 3,762,979 | 10/1973 | Hanel et al. . | |
| 3,862,870 | 1/1975 | Suda et al. . | |
| 3,935,361 | 1/1976 | Dorfman et al. . | |
| 3,994,454 | 11/1976 | Burgheimer . | |
| 4,156,425 | 5/1979 | Arkans . | |
| 4,216,046 | 8/1980 | Hackert . | |
| 4,268,338 | 5/1981 | Peterson | 156/274.4 |
| 4,338,150 | 7/1982 | Weeks . | |
| 4,402,312 | 9/1983 | Villari et al. | 601/152 |
| 4,410,575 | 10/1983 | Obayashi et al. . | |
| 4,470,857 | 9/1984 | Casalou . | |
| 4,624,244 | 11/1986 | Taheri . | |
| 4,643,932 | 2/1987 | Daniels . | |
| 4,662,037 | 5/1987 | Provost et al. . | |
| 4,761,318 | 8/1988 | Ott et al. . | |
| 4,857,129 | 8/1989 | Jensen et al. . | |
| 4,859,524 | 8/1989 | Kim et al. . | |
| 4,894,060 | 1/1990 | Nestegard . | |
| 4,950,347 | 8/1990 | Futagawa . | |
| 5,036,838 | 8/1991 | Sherman | 602/44 |
| 5,061,540 | 10/1991 | Cripps et al. . | |
| 5,095,894 | 3/1992 | Marble . | |
| 5,146,932 | 9/1992 | McCabe . | |
| 5,260,015 | 11/1993 | Kennedy et al. | 264/167 |
| 5,277,737 | 1/1994 | Li et al. | 156/274.8 |
| 5,392,782 | 2/1995 | Garrett | 606/202 |

FOREIGN PATENT DOCUMENTS

| | | |
|---|---|---|
| PCT/US85/02290 | 11/1985 | WIPO . |

*Primary Examiner*—Lynne A. Reichard
*Assistant Examiner*—Jeanne M. Clark
*Attorney, Agent, or Firm*—David J. Koris

[57] ABSTRACT

The invention concerns how the loop portion of a VELCRO fastener can be RF welded to a compression sleeve or other similar article. By using a simpler two-step method, in which the loop portion is provided with a backing laminated thereto, both labor and material costs have been reduced over the prior art five-step method.

8 Claims, 7 Drawing Sheets

HOOK AND LOOP ATTACHMENT FOR A COMPRESSION SLEEVE AND METHOD OF ATTACHING A HOOK AND LOOP FASTENER TO A COMPRESSION SLEEVE

This application is a continuation of application Ser. No. 08/280,800, filed Jul. 26, 1994, now abanodned

RELATED APPLICATIONS

This application is related to Ser. No. 08/127,019 of John F. Dye filed Sep. 27, 1993.

BACKGROUND OF THE INVENTION

The present invention relates to a novel compression sleeve for use in per se known systems for applying compressive pressure to a patient's leg. Prior to the present invention, various compression devices have been known in the art for applying compressive pressure to a patient's limbs in order to increase blood flow velocity. Particularly useful are the SCD (trademark of The Kendall Company, assignee of the present invention) sequential compression devices providing intermittent pulses of compressed air which sequentially inflate multiple chambers in a sleeve, beginning at the ankle and moving up the leg. This results in a wave-like milking action which empties the veins and results in greatly increased peak blood flow velocity, thus providing a non-invasive method of prophylaxis to reduce the incidence of deep vein thrombosis (DVT). These compression devices find particular use during surgery on patients with high risk conditions such as obesity, advanced age, malignancy, or prior thromboembolism. When a DVT occurs, the valves that are located within the veins of the legs can be damaged, which in turn can cause stasis and high pressure in the veins of the lower leg. Patients who have this condition often have swelling (edema) and tissue breakdown (venous stasis ulcer) in the lower leg.

Devices of the foregoing description are disclosed in various patents of which the following are illustrative: U.S. Pat. Nos. 4,013,069 and 4,030,488 of James H. Hasty, and U.S. Pat. No. 4,029,087 of, John F. Dye, all assigned to The Kendall Company.

As examples of other patents directed to compression sleeves for use in these systems, mention may be made of the following: U.S. Pat. Nos. 4,091,804; 4,156,425; 4,198 961; and 4,207,875

In general, the compression devices of the prior art comprise a sleeve having a plurality of separate fluid pressure chambers progressively arranged longitudinally along the sleeve from a lower portion of the limb to an upper portion. Means are provided for intermittently forming a pressure pulse within these chambers from a source of pressurized fluid during periodic compression cycles. Preferably, the sleeve provides a compressive pressure gradient against the patient's limbs during these compression cycles which progressively decreases from the lower portion of the limb, e.g. from the ankle to the thigh.

sequential pneumatic compression devices of the foregoing description applying compression to the lower limb have achieved considerable notoriety and wide acceptance as an effective non-invasive means for preventing deep vein thrombosis and for treating venous stasis ulcers.

They function by applying pneumatic compression sequentially and in gradient levels from ankle to thigh for a predetermined time, e.g. 11 seconds, followed by a period of time, e.g. 60 seconds, when no pressure is applied. The particular time period selected is chosen to be optimum for pushing venous blood out of the leg (during the compression cycle) and to allow arterial blood to refill the leg (during the decompression interval).

While the compression devices of the prior art for applying compressive pressure to the leg have enjoyed great commercial success and the clinical efficacy of the SCD devices in particular have been well documented, there nevertheless remains a need in the art for a sleeve of improved design for facilitating proper placement on the leg and for increased comfort to the patient wearing the sleeve.

stated simply, the task of this invention is to provide such an improved sleeve design.

These compression sleeves usually use hook and loop type fasteners to fasten one part of the compression sleeve to the other when it is placed on a patient. The hook and loop type fasteners are commonly known by the trademark VELCRO. Typically, the fasteners are attached to the compression sleeve by sewing. This has become unacceptable, however because sewing does not tend to lend itself to automation.

A better method was then used. This method uses a type of VELCRO fastener that can be RF welded to the sleeve rather than sewn. RF welding is known and described in patents such as U.S. Pat. No. 4,857,129, to Jensen, et al. This method solves many of the problems outlined above.

Finally, the instant improvement to the compression sleeves concerns how the loop portion of the VELCRO fastener is RF welded to its sheet of the compression sleeve. As shown in FIGS. 9A–9E, according to the prior art, a fairly complicated five-step process was used. First (FIG. 9A), the 12 mil vinyl strip portions 100 were cut to the appropriate size. These vinyl strip portions have slits 101 at opposite ends thereof to facilitate the removal of a "window" of vinyl, as will be described. Second (FIG. 9B), the loop portions 56 were cut to their appropriate size. Third (FIG. 9C), the loops 56 were welded 106 to the vinyl strip 100 to form a sub-assembly 105. This step was carried out in such a way that the vinyl strip 100 covered the loops 56, yet exposed the foam underside of the loop portion 56. Accordingly, this vinyl strip 100 was not a "backing" because it covered the front of loop portion 56. Fourth (FIG. 9D), this sub-assembly was reversed and the vinyl strip portion 100 of the subassembly was RF welded 107 to the sheet 30 of the compression sleeve with the foam underside portion contacting the sheet of the compression sleeve. Fifth (FIG. 9E) and finally, a "window" **100*a* of the vinyl strip 100 was removed to expose the loop structure after attachment. Slits 101 allowed for there to be a portion of the vinyl strip 100** which could be grasped for removal of the "window." This final step does not lend itself to automation and the overall process is quite cumbersome. Therefore, a method by which the loop portion could be directly bonded to the sheet of the sleeve was needed.

The prior art has not found such a method. For example, U.S. Pat. No. 4,643,932, to Daniels, generically recites that it is known to ultrasonically weld VELCRO to an article. He lacks any explicit description, however, on how this is accomplished by the prior art. When describing his invention, he does state that a heat activated adhesive film is used to bond the VELCRO portion to its backing, i.e., the article.

U.S. Pat. No. 4,894,060, to Nestegard broadly discusses a bonding layer for attaching his loop portion to the diaper, yet fails to describe any details, thereof.

U.S. Pat. No. 4,761,318, to Ott, et al., uses an infrared source in combination with pressing rollers to attach the loop portion to the substrate. This method, besides not showing some of the details of the instant claimed method, fails to allow discrete strips of loop material to be attached to discrete substrate materials, as does the instant invention.

other methods of attaching VELCRO to an article or substrate are shown in U.S. Pat. No. 5,061,540, to Cripps, et al. (fails to describe the details of how the VELCRO can be ultra-sonically welded to the article); U.S. Pat. No. 5,095,894, to marble (loop portion flame laminated to article); U.S. Pat. No. 4,470,857, to Casalou (first a barrier sheet is bonded to the substrate and then the VELCRO bonded to the barrier sheet); PCT/USA85/02290, to VELCRO USA (ultrasonically welding VELCRO to a substrate, and then attaching the substrate/VELCRO combination to the article as the article is molded, by encapsulating the substrate. Finally, U.S. Pat. No. 4,662,037, to Provost, et al., discloses the use of ultrasonic welding in order to create a selvedge (selvage). Furthermore, many of the above-mentioned patents use ultra-sonic rather than RF welding. These are distinctly different types of welding and RF welding is more suitable for welding PVC, the material that the compression sleeves are made from. RF welding uses radio frequency radiation (usually 27.12 Mhz) to induce molecular friction in the material to be welded, raising the temperature to its melting point. RF welding is useful for sealing polymers with strong dipoles, such as PVC.

OBJECTS OF THE INVENTION

It is an object of the invention to provide a novel way of attaching a fastener to compression sleeve.

It is a further object of the invention provide a to way of attaching a fastener to compression sleeve that has a neat appearance.

It is a further object of the invention to way of attaching a fastener to compression sleeve that lends itself more to automation.

These and other objects of the invention are achieved by: a compression sleeve, comprising: a pair of opposed sheets, each sheet having a perimeter; the pair of opposed sheets attached to one another along their respective perimeters; at least one pressure chamber within the sleeve; conduit means for introducing a pressurized gas into the at least one pressure chamber; a loop fastener portion, the loop fastener portion having a vinyl backing laminated thereto; and wherein the loop fastener portion is attached to one of the pair of sheets by RF welding the vinyl backing to the sheet.

BRIEF DESCRIPTION OF THE INVENTION

In accordance with the above discussion, this invention is directed towards a novel and much more economical manner of applying VELCRO components to any and all compression sleeves.

DETAILED DESCRIPTION OF THE INVENTION

As was heretofore mentioned, the present invention is directed to a new and improved system for providing VELCRO fasteners for compression sleeves for use in per se known systems for applying compressive pressure against a patient's leg.

The nature and objects of the invention will be readily understood by reference to the following detailed description in conjunction with the accompanying illustrative drawings.

A particularly preferred compression sleeve contemplated by this invention is shown in FIGS. 1–7, which sleeve is described and claimed in the aforementioned copending application of John F. Dye, Serial No. 08/127,019 filed Sep. 27, 1993.

Figure 1:
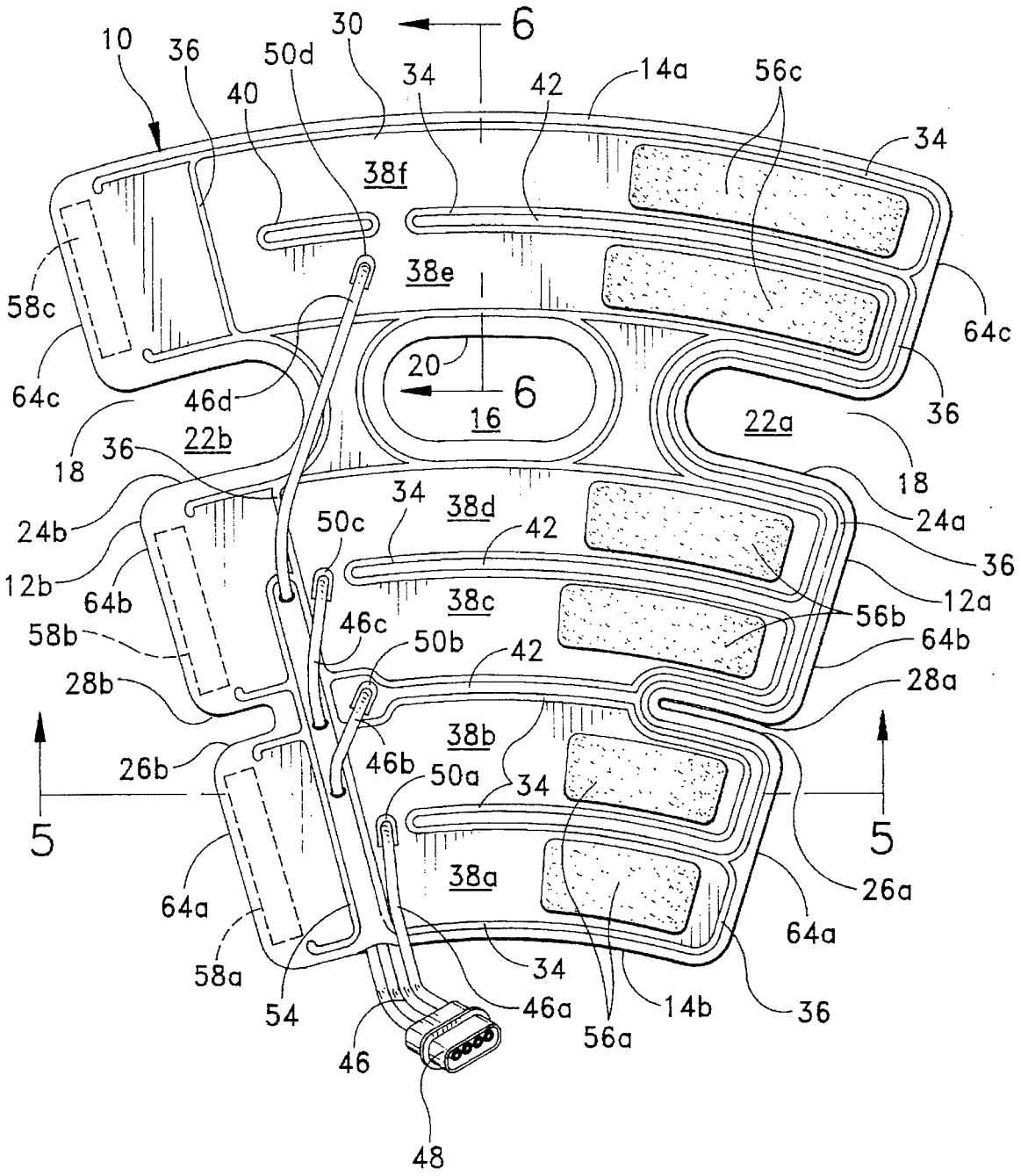
FIG. 1 is a plan view of the outer surface of the sleeve.

As shown therein with reference in particular to FIG. 1, the preferred sleeve 10 has its shape and dimensions defined by a pair of opposed side edges 12*a,b* and a pair of end edges 14*a,b* connecting the side edges, with the side edges 12*a* and 12*b* being tapered from an upper end adapted to enclose the thigh region toward a lower end for enclosing the ankle region of a patient.

The sleeve has an elongated opening 16 extending through what would be the knee region 18 when the sleeve is employed to apply compressive pressure to the leg, opening 16 being defined by peripheral edges 20 extending around the opening. In addition, the knee region 18 has elongated cut-outs or openings 22*a* and 22*b* on opposed side edges 12*a* and 12*b*, respectively, the openings 22*a* and 22*b* being defined by peripheral side edges 24*a* and 24*b*, respectively.

Additionally, for reasons which will be discussed hereinafter, the sleeve has cut-outs or openings 26*a* and 26*b* defined by peripheral edges 28*a* and 28*b* on opposed side edges 12*a* and 12*b*, respectively.

The sleeve has an outer gas-impervious sheet 30 (FIG. 1) and an inner gas-impervious sheet 32 (FIG. 2) adapted for placement against the leg of a patient. Sheets 30,32 are connected by a plurality of laterally extending sealing lines 34 and longitudinally extending sealing lines 36 connecting ends of the lateral lines 34, as shown. The sealing lines, which may, for example, be provided by heat-sealing, adhesive, radio frequency ("R.F.") welding, etc., define a plurality of longitudinally disposed chambers 38*a*, 38*b*, 38*c*, 38*d*, 38*e* and 38*f* which in per se known manner are capable of retaining pressurized air in order to exert compressive pressure to the leg during successive pressure-applying cycles. The outer sheet 30 may, for example, comprise a suitable flexible polymeric material such as polyvinyl chloride (PVC) on the order of 5–10 mils thick. The inner sheet 32 will preferably comprise a similar polymeric material, e.g. 5–10 mil PVC having laminated to the inner surface to be placed against the leg a non-woven material such as polyester for added comfort to the wearer.

When positioned around the leg, chambers 38*a* and b will apply compressive pressure to the ankle region; chambers 31*c* and *d* to the calf region; as heretofore noted openings 16, 22*a* and 22*b* will be in the knee region to enhance flexibility; and chambers 38*e* and *f* will apply compressive pressure to the thigh region.

While not essential to the practice of this invention, as shown in FIG. 1 an annular seal 40 is preferably provided in the thigh region for the purposes of completing the separation of the thigh region into lower and upper chambers 38*e* and *f* as the calf region is to lower and upper chambers 38*c* and *d*, and the ankle region in lower and upper chambers 38*a* and *b*.

In known manner, the sleeve is provided with a set of conduits 46*a*, 46*b*, 46*c* and 46*d* having a connector 48 for connecting the conduits to a controller (not shown) having a source of pressurized air. A tubing channel 52 (FIG. 5) defined by an inner seal line 36 and an outer seal line 54 is provided through which the conduits extend and then terminate at their trailing ends where ports 50*a*, 50*b*, 50*c* and 50*d* are provided for conducting air into the sleeve.

As shown, conduit 46*a* leads into the ankle chambers, conduit 46*c* into the calf chambers, and conduit 46*d* into the thigh chambers.

Figure 2:
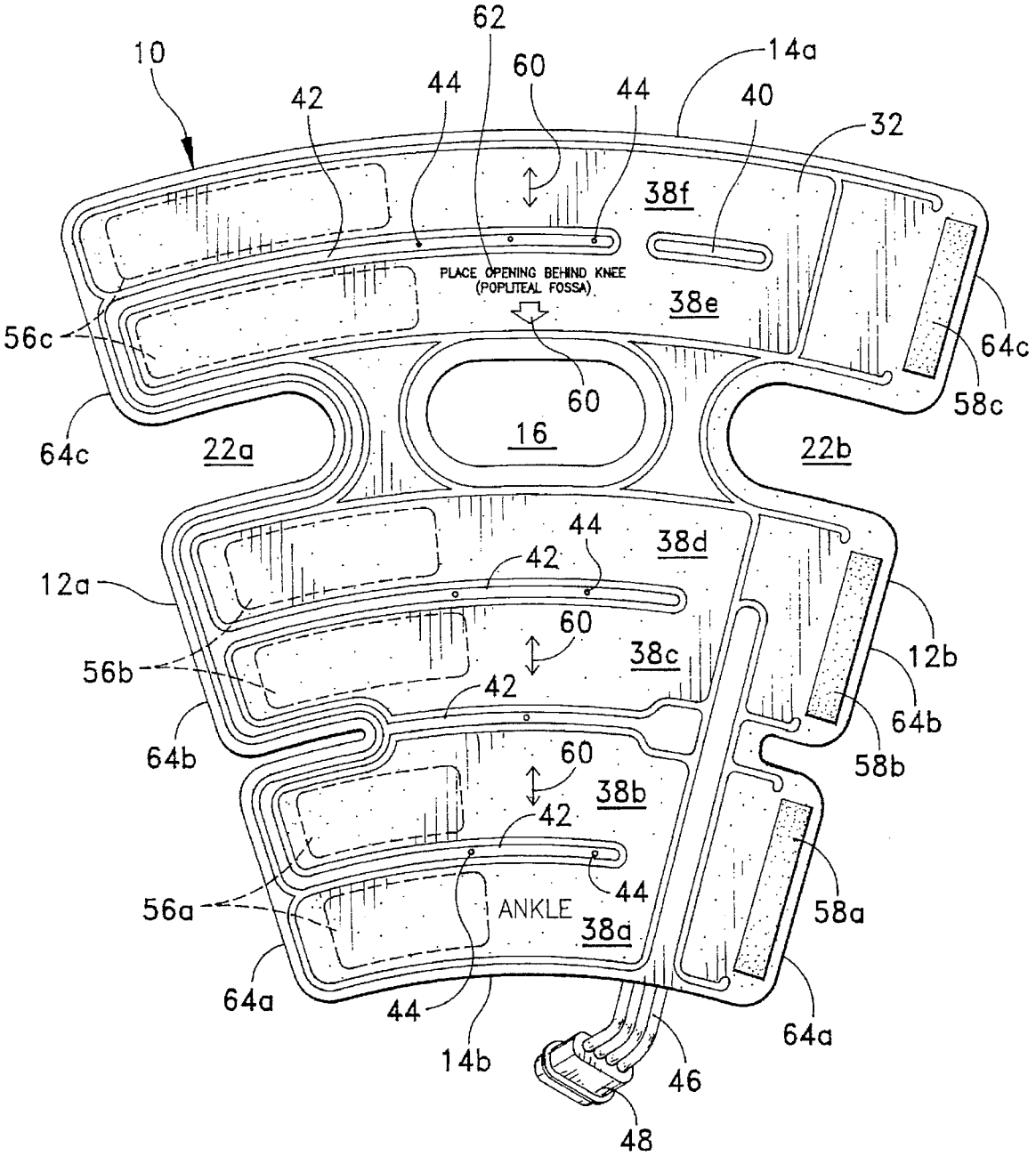
FIG. 2 is a plan view of the inner surface to be applied against the leg.
Figure 3:
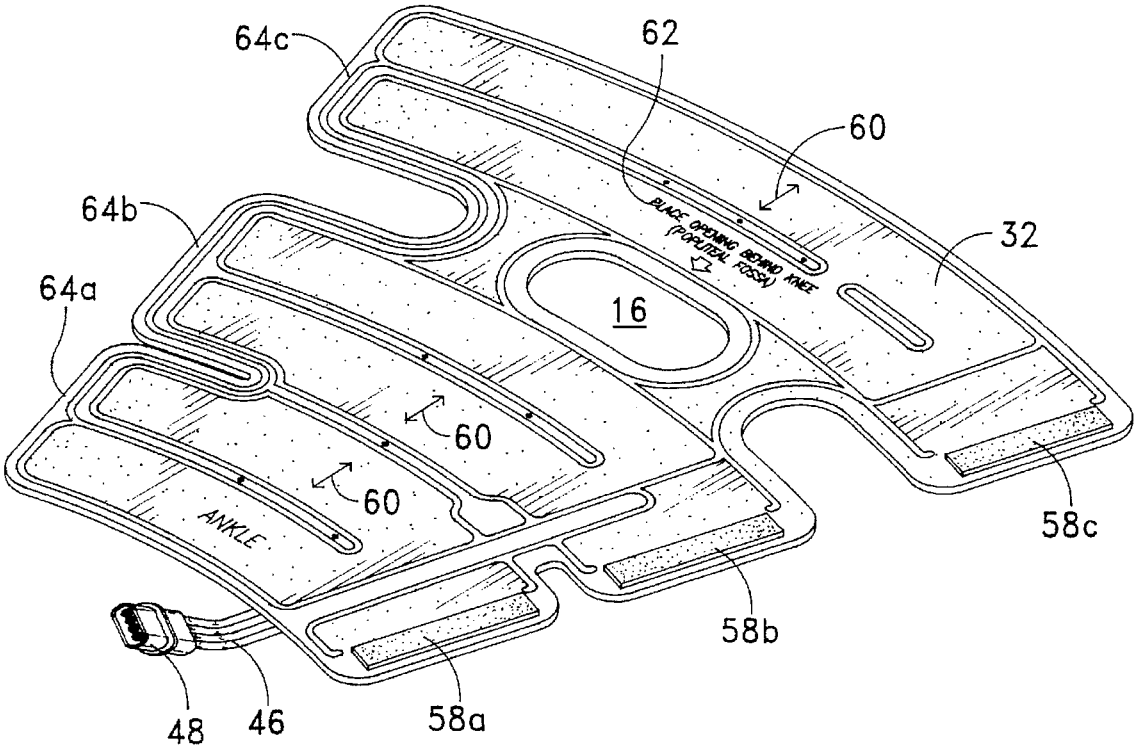
FIG. 3 is a perspective view of the inner surface of the sleeve.

Conduit 46*b* leads into a ventilation channel 42 which, as best seen in FIG. 2, extends throughout the compression chambers and is provided with apertures or small openings 44 on the inner sheet for the known function of cooling the leg and thus contributing to the general comfort of the wearer.

Figure 4:
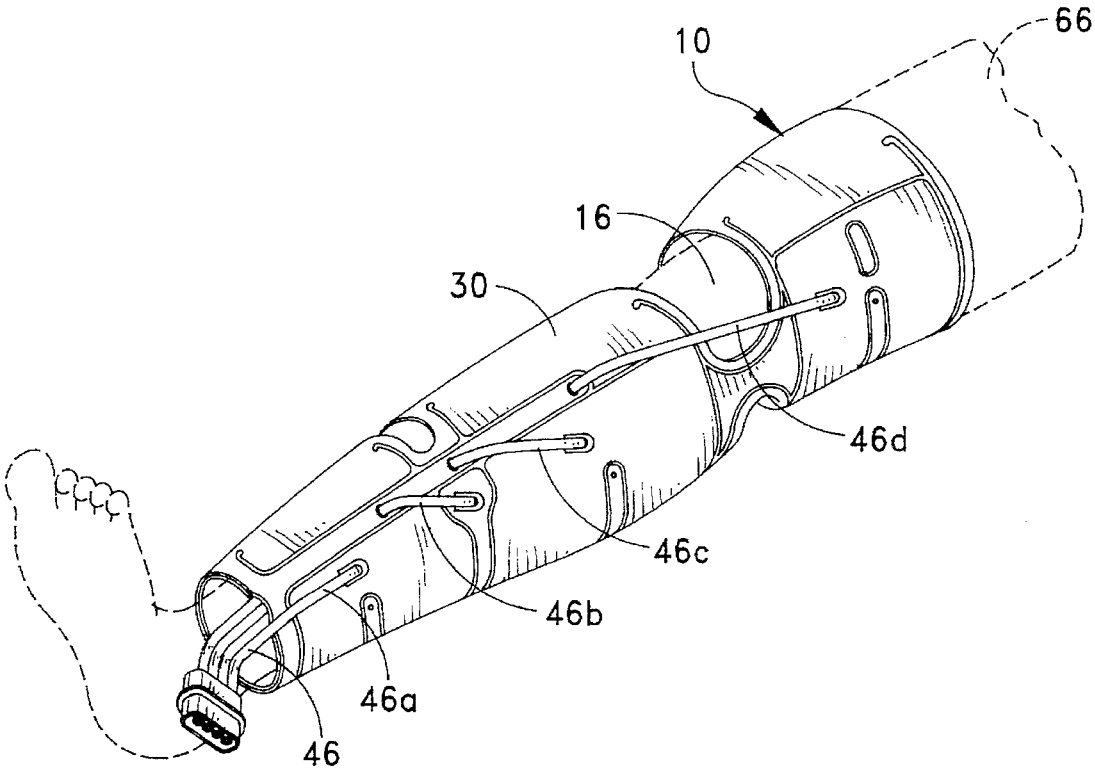
FIG. 4 is an applied perspective view showing the sleeve wrapped around the leg.
Figure 5:
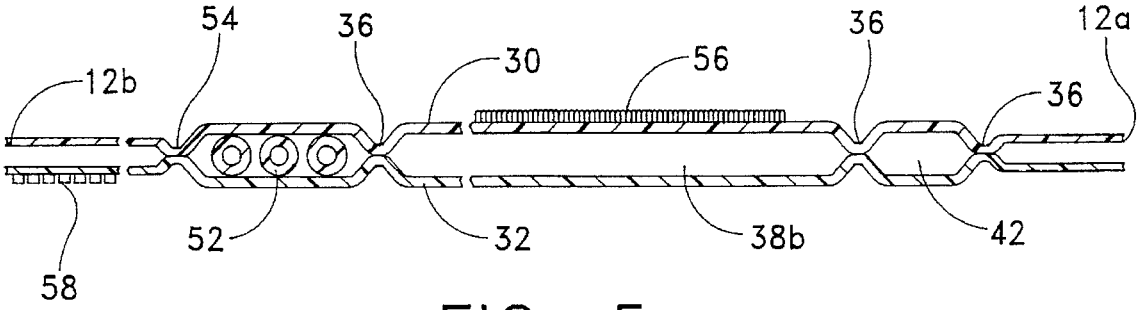
FIG. 5 is a sectional view taken along line 5—5 in FIG. 1.
Figure 6:
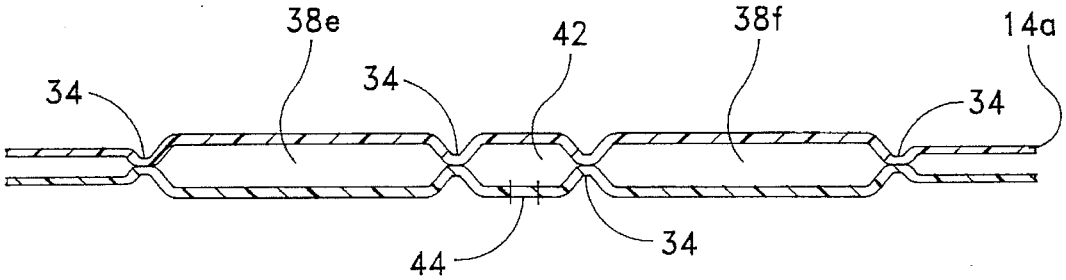
FIG. 6 is a sectional view taken along line 6—6 in FIG. 1.

The outer sheet 30 has a set of spaced strips 56*a*, 56*b* and 56*c*, such as loop material sold under the trademark VELCRO, extending laterally at the ankle, calf and thigh chambers and cooperating with a set of spaced VELCRO hook material 58*a*, 58*b* and 58*c* on the inner sheet for releasably fastening the sleeve encircling the leg, as seen in FIG. 4. This application is concerned with a novel and much more economical manner of applying the VELCRO strips 56 *a–c* to the sheets of the compression sleeve As will be appreciated, wide variations may be found in the proportions of the ankle, calf and thigh regions in a patient's leg. One may, for example, have relatively thin ankles and proportionally thicker thighs or overdeveloped calf muscles, as might be the case with athletes.

For this reason, an important feature of the sleeve shown in the illustrative drawings is the design providing opposed flaps 64*a*, 64*b* and 64*c*, each having its own cooperating Velcro loop and hook materials 56*a–c* and 58*a–c*, respectively, so that each of the ankle, calf and thigh chambers may be individually and selectively adjusted around the leg to accommodate the particular shape and thicknesses of the individual's ankle, calf and thigh.

The SCD sleeves currently commercially available and shown in the patent literature such as those patents mentioned above are not symmetrical in the sense that the knee opening 16 is centrally disposed. This is because the sleeve design is such that when properly positioned on the leg it is fastened on the side.

For proper alignment on the leg some degree of experience by the clinician is required. For this reason, the high turnover in attending clinicians presents a problem in positioning the sleeve properly encircling the leg.

Another important feature of the illustrated compression sleeve is the symmetrical design and indicia making it easy for inexperienced clinicians to apply the compression sleeve to a patient.

With reference to FIGS. 2 and 4, for proper alignment, with the patient lying down the sleeve is placed under the patient's leg with the inner surface 32 against the leg such that the arrows 60 are aligned substantially centrally behind the leg.

Figure 7:
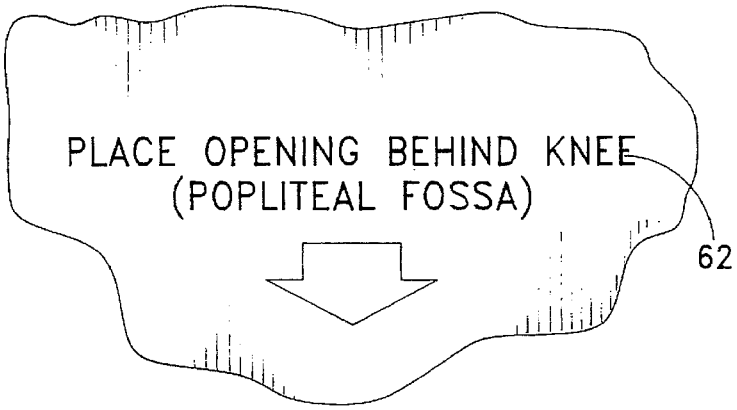
FIG. 7 is an enlarged view showing the illegible indicia in FIG. 2.

With reference to FIGS. 2 and 7, the sleeve may then be adjusted vertically as directed by indicia 62, and while maintaining proper alignment of the arrows 60 so that opening 16 is placed behind the knee (popliteal fossa). When so positioned, the lowest portion of the sleeve designated "ANKLE" will then be in the ankle region of the patient's leg.

The sleeve may then be secured around the leg in the manner heretofore described by superposing the flaps 64 so that the VELCRO strips 56,58 secure the sleeve in place. When so secured, openings 22*a* and 22*b* are brought together to form an elongated opening over the knee.

By way of recapitulation, the compression sleeve described and claimed in the aforementioned copending application Ser. No. 08/127,019, and discussed above with reference to FIGS. 1–7, affords significant advantages over the current state of the art.

The symmetrical design with the accompanying indicia makes it very easy for even new or inexperienced personnel to apply the sleeve properly. Rather than reliance on accompanying brochures or other literature instructing the clinician, which literature is often not available or, if available, not read, each individual sleeve contains indicia clearly directing the placement of the sleeve.

The centralized opening 16 behind the knee provides improved flexibility and hence increased comfort over that obtained simply by a knee opening over the knee, e.g. the opening provided by bringing openings or cut-outs 22*a* and *b* together when securing the sleeve on the leg.

Another important feature is the provision of the flaps 64*a,b* and *c* permitting proper adjustment of each of the ankle, calf and thigh chambers individually so as to accommodate the particular shape and contour of the patient's leg and thereby, in turn, assuring that the proper preselected pressure profile is applied to the leg by the individual compression chambers. As will be appreciated, the flaps also greatly facilitate the readjustments which may be required for proper fitting by permitting selective separation of less than all of the flaps formed by the mating loop strips 56.

As will be appreciated by those skilled in the art, the novel compression sleeve shown in the illustrative drawings and described and claimed in the aforementioned copending application can be employed with the SCD Controllers and tubing sets known in the art and currently commercially available to apply a sequential compressive gradation to the leg.

In use, after placement of the sleeve(s) on the patient's leg(s) and connection to the controller by the tubing set, the controller may then be initiated in order to supply air to the sleeve(s). In a known manner, the controller intermittently inflates the ankle chambers 38*a,b*, then the calf chambers 38*c,d*, and finally thigh chambers 38*e,f*, sequentially during periodic compression cycles in a pressure gradient profile which decreases from the lower or ankle portion of the sleeve to the upper or thigh portion of the sleeve.

Deflation between successive inflation cycles occurs in known manner by return of air through the conduits 46 to the controller where it is then vented to the atmosphere through an exhaust tube.

As mentioned, the controller also supplies air through conduit 46*b* into ventilation channels 42 where it then passes through apertures 44 in the ventilation channels onto the patient's legs. In this manner, the sleeve 10 ventilates a substantial portion of the legs to prevent heat buildup and thereby provide comfort from the cooling effect during the extended periods of time in which the sleeves are normally retained in a wrapper configuration about the patient's legs.

It will be appreciated that the compression sleeves to which this present invention is directed are not limited to the preferred design shown in the illustrative drawings. For example, compression sleeves having multiple chambers for applying compressive pressure to the leg are, per se, well known in the art, being both commercially available and disclosed in the patent literature, including those patents previously mentioned.

Moreover, sleeves for applying compressive pressure to the legs are also known in the art which have a single inflatable chamber or a lesser number of chambers than the sleeve shown in the drawings. Likewise, compression sleeves are known which have but a single conduit into the sleeve from a source of pressurized air. Also, it will be appreciated that the conduit providing cooling air to a ventilating chamber is not necessary to the practice readily suggested in the light of the foregoing detailed description and may accordingly be a matter of individual whim or desire.

Figure 10A:
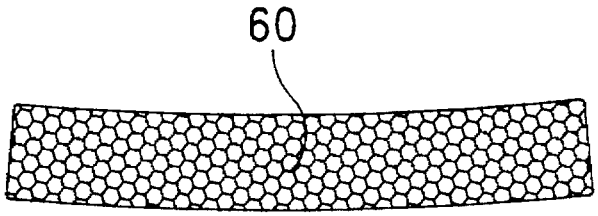
FIGS. 10A–B are plan views the two steps by which the loop portions are attached to the compression sleeves according to the process of the disclosed invention.
Figure 10B:
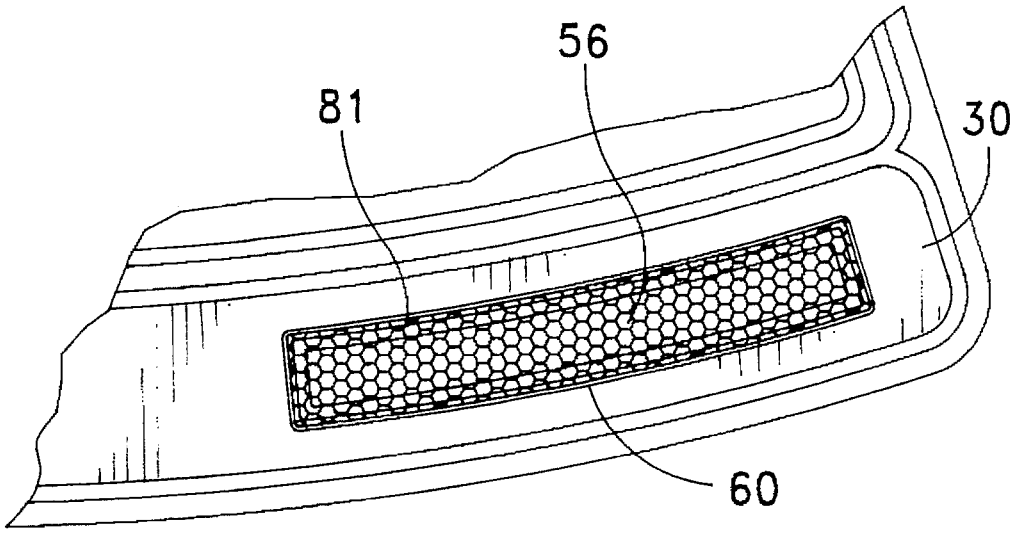

FIG. 10 shows the novel two-step method of attaching one of the parts of the VELCRO fastener to the sleeve. Although this figure shows sealable loop closure component 60 being RF welded to the outer sheet 30, it can be the same method by which hook material 58 is welded to inner sleeve 32. As shown in FIG. 10B after loop closure component 60 is RF welded to the outer sheet 30, there still is an outer portion 81 of the loop material 56 formed. This outer portion 81 is substantially smaller than the outer portion 81 obtained by the previous welding process and, therefore, any bending away of the VELCRO is greatly reduced. This outer portion is substantially smaller because there is no need for using a clamp in the RF welding process. During RF welding, the loop material and the top sheet of the sleeve are held together by the electrode and the bed or bolster (electrical ground) of the RF welding apparatus. Due to this small size in combination with the natural rigidity of the fastener material, even after continued use of the sleeve, there will be no bending upwardly from the outer sheet 30 or separation therefrom as in the prior art. Thus, even a sleeve that has been used many times will appear brand new to the patient.

Figure 8:
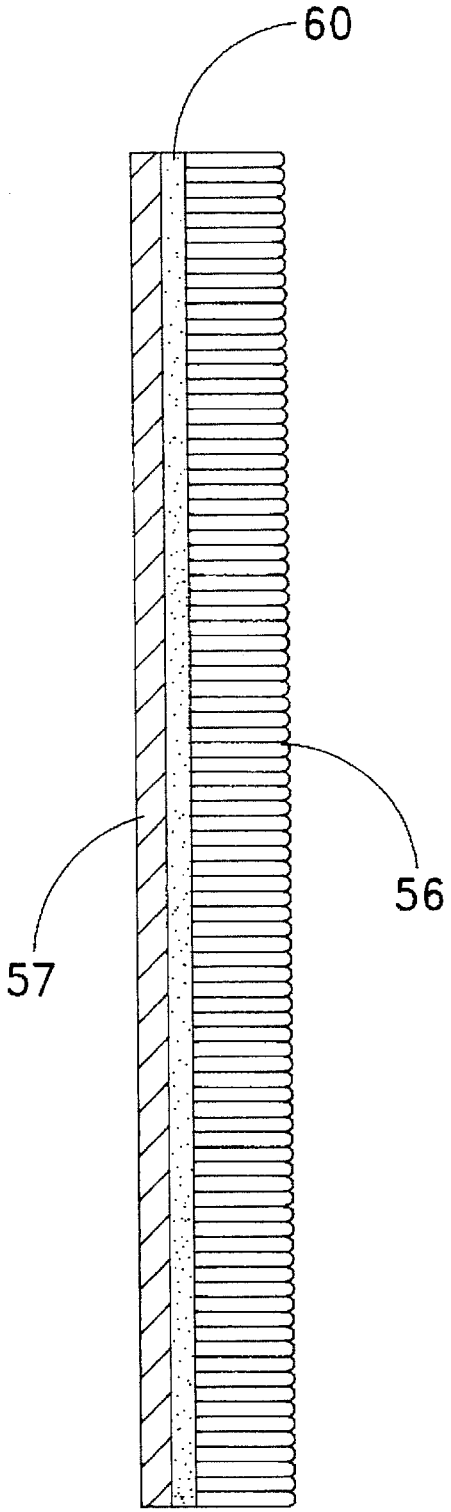
FIG. 8 is a cross-section of the loop sub-assembly for use with the process of the disclosed invention.
Figure 9A:
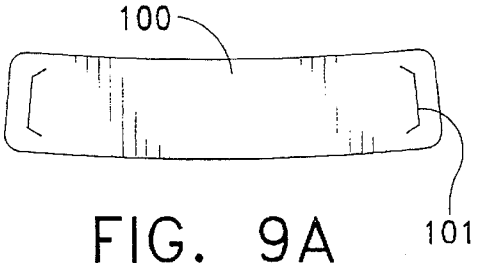
FIG. 9A (PRIOR ART)
FIGS. 9A–E are plan views of the five steps by which the loop portions have been attached to the compression sleeves according to the prior art.
Figure 9B:
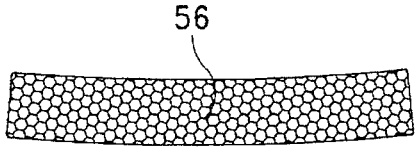
FIG. 9B (PRIOR ART)
Figure 9C:
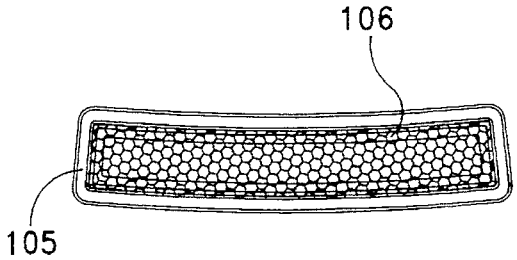
FIG. 9C (PRIOR ART)
Figure 9D:
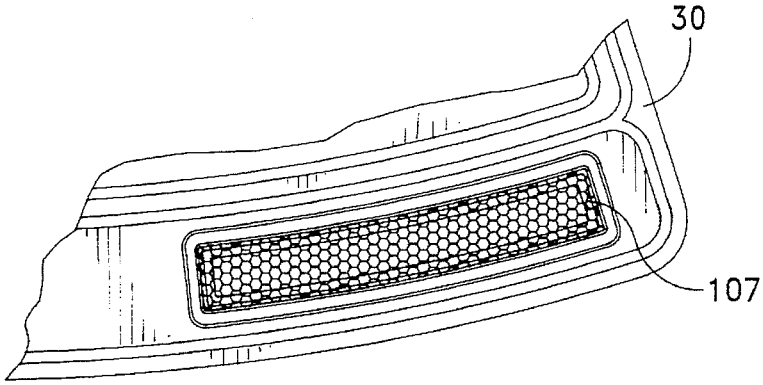
FIG. 9D (PRIOR ART)
Figure 9E:
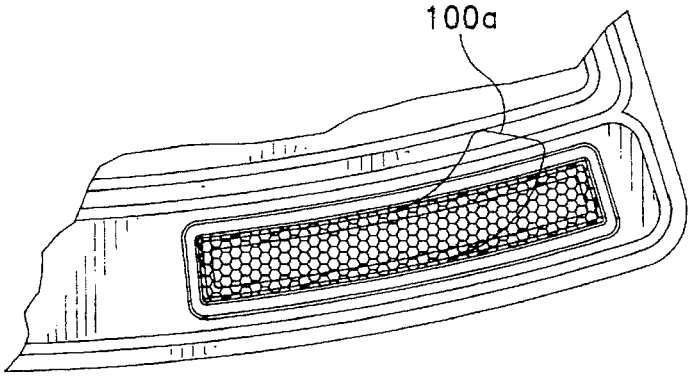
FIG. 9E (PRIOR ART)

In order for the RF welding process to be more easily used in attaching the fastener to the sleeve, a new type of VELCRO fastener is used. This VELCRO fastener is shown in FIG. 8 and comprises a sealable loop closure component 60. This component 60 comprises a loop portion 56 with a thin backing 57 laminated to it. This component is made by laminating large sheets of loop portion to large sheets of backing and then cutting and stamping out the individual components 60. The backing is made from a polyolefin material such as vinyl. Because of the cutting and stamping process, the vinyl backing 57 has the same dimensions as the loop portion 56. This vinyl backing 57 can be more easily RF welded to the top sheet 30 of the compression sleeve. It was also discovered that it was necessary for the dimensions of the vinyl backing and the loop portion 56 being welded to be larger than that of the welding head or else burning of the vinyl would occur. The single RF weld required by this method is within the perimeter of the loop portion 56. Furthermore, the raw material for the sub-assembly is constructed by an outside contractor and is not, therefore, part of the sleeve assembly process at the factory. This structure alleviates the need for the use of the complex process described above that involved the removal of a "window" of vinyl to expose the loops.

This novel two-step process has increased productivity. According to the five-step prior art method of welding the loop portion subassembly to the compression sleeve, it took 0.9496 man hours to produce a case of ten sleeves. According to the two-step method of welding the sealable loop closure component 60 to the compression sleeve according to the invention, it takes 0.7806 man hours to produce a case of ten sleeves. This is a savings of 0.1690 man hours per case of ten sleeves. This savings is solely the result of changing how the loop portion of the VELCRO is attached to the compression sleeve.

It should be noted that even if, according to the five-step prior art method, steps 1–3 were separately carried out to produce a supply of sub-assemblies, this would still be more cumbersome than the instant two-step method. This is because the modified prior art method would still have more steps then the instant method. The modified prior art method would consist of three steps. In particular, the steps would comprise: producing the sub-assembly, RF welding it to the sleeve, and removing the vinyl "window." Not only does the instant method have only two steps, it lacks the more cumbersome step of removing the "window". This is the step that makes automation more difficult. As the method according to the invention lacks this step, automation is more easily implemented.

Finally, the novel-two step method according to the invention has reduced material costs. According to the instant two-step method, the total cost, per sleeve, is reduced by almost 30%. This cost reduction is entirely attributable to the cost of the sealable pile closure component 60.

Since certain changes may therefore be made without departing from the scope of this invention, it shall be understood that the foregoing description and illustrative drawings shall be taken as being illustrative and not in a limiting sense.

That which is claimed:

1. A portion of a compression sleeve, comprising:

a pair of opposed sheets, each sheet having a perimeter;

said pair of opposed sheets attached to one another along their respective perimeters;

at least one pressure chamber within said sleeve;

conduit means for introducing a pressurized gas into said at least one pressure chamber;

a loop fastener component having a perimeter and comprising a loop fastener portion having a back surface and a backing having a front surface, said loop fastener portion laminated to said backing with said back surface contacting said front surface, said loop fastener portion and said backing having the same dimensions; and wherein said loop fastener portion is attached to one of said pair of sheets by RF welding said backing to said sheet with a continuous single RF weld entirely within the perimeter of the loop fastener component.

2. The article according to claim 1, wherein a perimeter of said loop fastener portion is not deformed with respect to said backing.

3. A method of attaching a fastener to a compression sleeve, comprising the steps of:

providing a sub-assembly having a perimeter and comprising a loop portion having a back surface and a backing having a front surface, said loop fastener portion laminated to said backing with said back surface contacting said front surface L said loop fastener portion and said backing having the same dimensions; and RF welding said sub-assembly to a sheet of said compression sleeve with a continuous single RF weld within the perimeter of the sub-assembly.

4. The method according to claim 3, wherein said step of providing a sub-assembly includes:

providing a sheet of loop material containing said loop portion larger than said sub-assembly;

providing a sheet of backing material larger than said sub-assembly;

laminating said sheet of loop material to said sheet of backing material; and stamping a plurality of sub-assemblies out of said larger laminated sheet.

5. The method according to claim 3, wherein said step of RF welding includes using an RF welding machine with weld head that is smaller than said subassembly.

6. In a device for applying compressive pressure against a patient's leg from a source of pressurized gas comprising an elongated sleeve for enclosing a length of the patient's leg, the sleeve having a pair of opposed side edges and a pair of opposed end edges connecting the side edges, the side and end edges together defining the shape and dimensions of the sleeve, at least one pressure chamber within the sleeve, conduit means for introducing the pressurized gas within the chamber(s) of the sleeve, and a fastener component extending longitudinally along the side edges for releasably securing the sleeve surrounding the leg;

the improvement wherein said fastener component has a perimeter and comprises a loop fastener portion having a back surface and a backing having a front surface, said loop fastener portion laminated to said backing with said back surface contacting said front surface, said loop fastener portion and said backing having the same dimensions; and wherein said fastener component is attached to said sleeve by RF welding said backing to said sleeve with a continuous single RF weld within the perimeter of the fastener component.

7. A device as defined in claim 6 where the sleeve has a plurality of compression chambers, each chamber having at least one associated pair of flaps.

8. A device for applying compressive pressure against a patient's leg from a source of pressurized fluid, comprising:

an elongated pressure sleeve for enclosing a length of the patient's leg;

said sleeve having a pair of opposed sheets, each of which having a perimeter, each said sheet being attached to the other along their respective perimeters;

at least one pressure chamber within said sleeve;

conduit means for introducing pressurized fluid into said at least one pressure chamber from the source of pressurized fluid; and a fastener assembly for releasably securing said sleeve around the patient's leg, said assembly comprising separate loop and hook fastener components adapted for placement over each other when said sleeve is wrapped around the patient's leg, the loop fastener component having a perimeter and comprising a loop fastener portion having a back surface and a backing having a front surface, said loop fastener portion laminated to said backing with said back surface contacting said front surface, said loop fastener portion and said backing having the same dimensions, and wherein said loop fastener portion is attached to one of said pair of sheets by RF welding said backing to one of said pair of sheets with a continuous single RF weld within the perimeter of the loop fastener component.

* * * * *